US005300994A

United States Patent [19]

Gross et al.

[11] Patent Number: 5,300,994

[45] Date of Patent: Apr. 5, 1994

[54] TRANSFER SYSTEM INCLUDING A CAM ACTUATED SEGMENTED FLEXIBLE TRANSFER ASSIST BLADE

[75] Inventors: Robert A. Gross, Penfield; Lisbeth S. Quesnel, Pittsford, both of N.Y.

[73] Assignee: Xerox Corporation, Stamford, Conn.

[21] Appl. No.: 55,048

[22] Filed: Apr. 29, 1993

[51] Int. Cl.[5] ..... G03G 15/14

[52] U.S. Cl. ..... 355/277; 355/271

[58] Field of Search ..... 355/271, 272, 273, 274, 355/275, 276, 277, 200, 210

[56] References Cited

U.S. PATENT DOCUMENTS

| | | | |
|---|---|---|---|
| 4,101,212 | 7/1978 | Sumiyoshi et al. | 355/274 |
| 4,392,738 | 7/1983 | Fujino et al. | 355/271 |
| 4,415,257 | 11/1983 | Kopp et al. | 355/277 |
| 4,541,709 | 9/1985 | Kampschreur | 355/277 |
| 4,943,863 | 7/1990 | Ainoya | 355/271 |
| 4,947,214 | 8/1990 | Baxendell et al. | 355/274 |
| 5,182,602 | 1/1993 | Kakita et al. | 355/271 |

OTHER PUBLICATIONS

U.S. Patent Application Serial No. 07/755,412; Inventors-R. Smith et al; Filed-Sep. 5, 1991 [Copy not enclosed].

U.S. Patent Application Serial No. 07/933,639; Inventors-R. Smith et al; Filed-Aug. 24, 1992 [Copy not enclosed].

*Primary Examiner*—A. T. Grimley
*Assistant Examiner*—Sandra L. Brasé
*Attorney, Agent, or Firm*—Denis A. Robitaille

[57] ABSTRACT

A transfer system including a contact member for applying pressure against a copy substrate to create uniform contact between the copy substrate and a developed image on an imaging member. The transfer system includes a flexible transfer assist blade and a rotatable cam shaft having a lobe for deflecting the transfer assist blade into contact with the copy substrate. Alternatively, the transfer assist blade may include multiple segments and the rotatable cam shaft may include a plurality of lobes, each having a lengthwise dimension corresponding to predetermined segments of the blade for providing contact across a dimension corresponding to that of the copy substrate. The system further includes a stepper motor for rotating the cam to predetermined angular positions to create an abutting relationship between the lobe and the transfer assit blade for deflecting selected segments of the blade toward the copy substrate. The transfer assist blade presses the copy sheet into contact with at least the developed image on the photoconductive surface to substantially eliminate any spaces or gaps between the copy sheet and the developed image during transfer of the developed image from the photoconductive surface to the copy sheet.

10 Claims, 5 Drawing Sheets

TRANSFER SYSTEM INCLUDING A CAM ACTUATED SEGMENTED FLEXIBLE TRANSFER ASSIST BLADE

The present invention relates generally to a system for assisting transfer of a developed image to a copy substrate in an electrostatographic printing apparatus, and more particularly concerns an apparatus for enhancing physical contact between the copy substrate and the developed image situated on a photoreceptive member.

Generally, the process of electrostatographic copying is initiated by exposing a light image of an original document onto a substantially uniformly charged photoreceptive member. Exposing the light image onto the charged photoreceptive member discharges a photoconductive surface thereon in areas corresponding to non-image areas in the original document while maintaining the charge in image areas, thereby creating an electrostatic latent image of the original document on the photoreceptive member. Thereafter, developing material comprising charged toner particles is deposited onto the photoreceptive member such that the toner particles are attracted to the charged image areas on the photoconductive surface to develop the electrostatic latent image into a visible image. This developed image is then transferred from the photoreceptive member, either directly or after an intermediate transfer step, to an image support substrate such as a copy sheet, creating an image thereon corresponding to the original document. The transferred image is typically affixed to the image support substrate to form a permanent image thereon through a process called "fusing". In a final step, the photoconductive surface of the photoreceptive member is cleaned to remove any residual developing material thereon in preparation for successive imaging cycles.

The electrostatographic copying process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

The process of transferring charged toner particles from an image bearing member such as the photoreceptive member to an image support substrate such as the copy sheet is realized at a transfer station. The transfer process is enabled by overcoming adhesive forces holding the toner particles to the image bearing member. In a conventional electrostatographic machine, transfer is achieved by transporting the image support substrate into the area of the transfer station where electrostatic force fields sufficient to overcome the forces holding the toner particles to the photoconductive surface are applied to attract and transfer the toner particles over onto the image support substrate. In general, transfer of developed toner images in electrostatographic applications has been accomplished via electrostatic induction using a corona generating device, wherein the image support substrate is placed in direct contact with the developed toner image on the photoconductive surface while the reverse side of the image support substrate is exposed to a corona discharge. This corona discharge generates ions having a polarity opposite that of the toner particles, thereby electrostatically attracting and transferring the toner particles from the photoreceptive member to the image support substrate. An exemplary corotron ion emission transfer system is disclosed in U.S. Pat. No. 2,836,725.

Unfortunately, the interface between the photoreceptive surface and the image support substrate is not always optimal. Problems may occur in the transfer process when spaces or gaps exist between the developed image and the image support substrate. There is a tendency for toner not to transfer across these gaps, causing a copy quality defect referred to as "transfer deletion". In particular, non-flat or uneven image support substrates, such as copy sheets that have been mishandled, left exposed to the environment or previously passed through a fixing operation (e.g., heat and/or pressure fusing) tend to promulgate imperfect contact with the photoreceptive surface of the photoconductor.

As described, the process of transferring development materials in an electrostatographic system involves the physical detachment and transfer-over of charged toner particles from an image bearing photoreceptive surface into attachment with an image support substrate via electrostatic force fields. One critical aspect of the transfer process is focused on the application and maintenance of high intensity electrostatic fields in the transfer region for overcoming the adhesive forces acting on the toner particles as they rest on the photoreceptive member. In addition, other forces, such as mechanical pressure or vibratory energy, have been used to support and enhance the transfer process. Careful control of these electrostatic fields and other forces is required to induce the physical detachment and transfer-over of the charged toner particles without scattering or smearing of the developer material.

The problem of transfer deletion has been addressed through various approaches. For example, an acoustic agitation system incorporating a resonator suitable for generating vibratory energy arranged in line with the back side of the photoconductor to apply uniform vibratory energy thereto has been disclosed in commonly assigned U.S. Pat. No. 5,081,500 as a method for enhancing toner release from the photoreceptive surface. In accordance with the concept of that patent, toner can be released from the image bearing surface of the photoconductor despite the fact that electrostatic charges in the transfer zone may be insufficient to attract toner over to the image support substrate.

Alternatively, mechanical devices that force the image support substrate into intimate and substantially uniform contact with the image bearing surface have been incorporated into transfer systems. Using this approach, various contact blade arrangements have been proposed for sweeping over the backside of the image support substrate at the entrance to the transfer region. The present invention is directed toward such a mechanical device wherein a segmented flexible transfer assist blade is deflected against a copy sheet by means of a multi-lobe device. The following disclosures may be relevant to various aspects of the present invention:

U.S. Pat. No. 4,947,214; Patentee: Baxendell, et al.; Issued: Aug. 7, 1990.

U.S. patent application Ser. No. 07/755,412; Inventors: R. Smith et al.; Filed: Sept. 5, 1991.

U.S. patent application Ser. No. 07/933,639; Inventors: R. Smith et al.; Filed: Aug. 24, 1992.

The relevant portions of the foregoing disclosures may be briefly summarized as follows:

U.S. Pat. No. 4,947,214 to Baxendell et al. discloses a system for transferring a developed image from a photoconductive surface to a copy sheet, including a corona generating device and a transfer assist blade. The blade is shifted via a solenoid-activated lever arm from a non-operative position spaced from the copy sheet, to an operative position, in contact with the copy sheet for pressing the copy sheet into contact with the developed image on the photoconductive surface to substantially eliminate any spaces therebetween during the transfer process. Although a practical implementation of that patent has been utilized with relative success in the Xerox Corporation model 5090 Duplicator, Baxendell, et al. provide an embodiment wherein a load is normally applied to the transfer assist blade for deflecting the blade in its non-operative position, the load being removed (by means of a solenoid) to allow the blade to move to its operative position. It has been found that this sustained load on the blade while in its non-operative position reduces the life expectancy of the blade and causes stress failures, resulting in more frequent servicing of the machine.

U.S. patent application Ser. No. 07/755,412 discloses an apparatus for enhancing contact between a copy sheet and a developed image positioned on a photoconductive member which includes a contact member being spaced apart from the copy sheet in a first mode of operation and being in contact with the copy sheet in a second mode of operation. The apparatus of that invention includes a cam movable between a first position and a second position as well as a mechanism for moving the cam between its first position and its second position for positioning the contact member in its first mode of operation in response to the cam being moved to its first position and in its second mode of operation in response to the cam being moved to its second position.

U.S. patent application Ser. No. 07/933,639 discloses a transfer blade for ironing a sheet against a photoreceptor belt during transfer, thereby smoothing out deformities which cause deletions. The transfer blade of that patent application includes a flexible tip to absorb the impact of the blade as it contacts the paper and a spring load to limit and control the force applied to the sheet. Sensors are also utilized to monitor and adjust the timing of the transfer blade.

In accordance with one aspect of the present invention, there is provided an apparatus for providing substantially uniform contact between a copy substrate and a developed image located on an imaging member, comprising contact means, adapted to move from a non-operative position spaced from the imaging member to an operative position in contact with the copy substrate on the imaging member, for applying pressure against the copy substrate in a direction toward the imaging member, and means, including an elevated deflecting surface, for applying a load to the contact means to deflect the contact means into the operative position.

In accordance with another aspect of the present invention, there is provided an electrostatographic printing machine including a transfer station for transferring a developed image from a moving imaging member to a moving copy substrate, the system including an apparatus for providing substantially uniform intimate contact between the copy substrate and the developed image located on the imaging member, comprising contact means, adapted to move from a non-operative position spaced from the imaging member to an operative position in contact with the copy substrate on the imaging member, for applying pressure against the copy substrate in a direction toward the imaging member, and means, including an elevated deflecting surface, for applying a load to the contact means to deflect the contact means into the operative position.

These and other aspects of the present invention will become apparent from the following description in conjunction with the accompanying drawings, in which.

Figure 1:
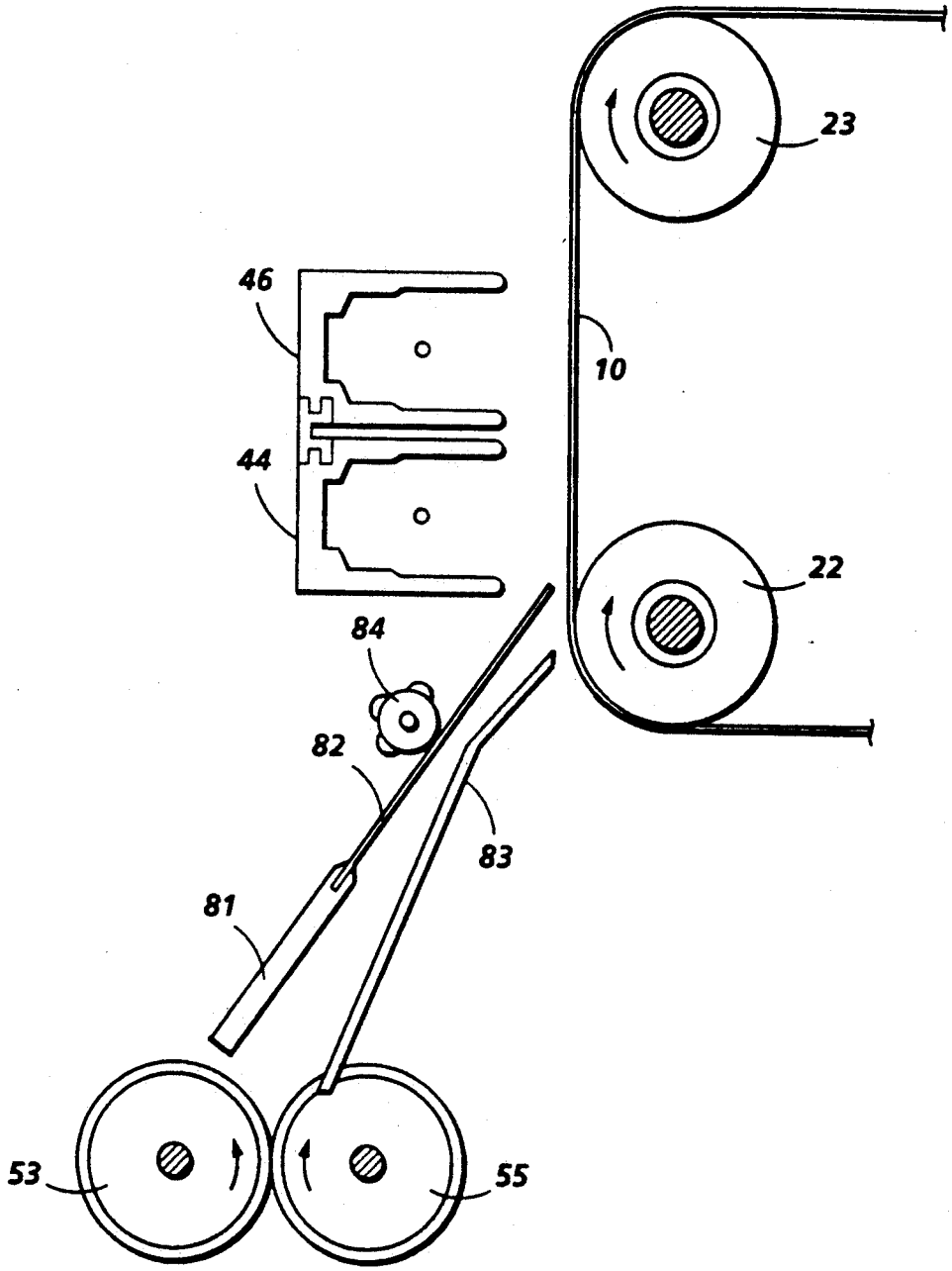
FIG. 1 is an enlarged schematic elevational view showing the transfer assist apparatus of the present invention.

While the present invention will be described with reference to a preferred embodiment thereof, it will be understood that the invention is not to be limited to this preferred embodiment. On the contrary, it is intended that the present invention cover all alternatives, modifications, and equivalents as may be included within the spirit and scope of the invention as defined by the appended claims. Other aspects and features of the present invention will become apparent as the following description progresses, with specific reference to the drawings, wherein like reference numerals have been used throughout to designate identical elements.

Figure 5:
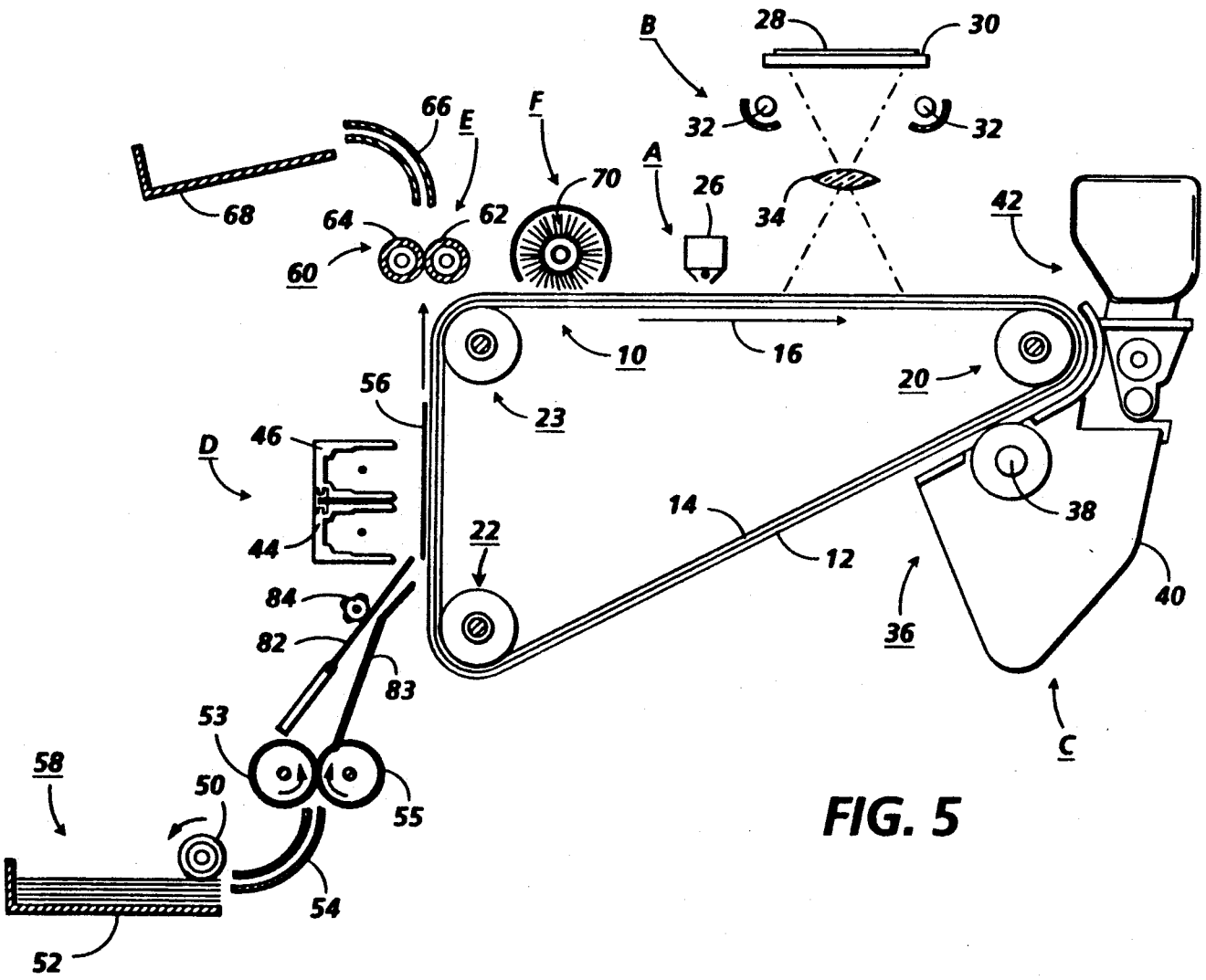
FIG. 5 is a schematic elevational view of an exemplary electrophotographic reproducing machine including an illustrative embodiment of the transfer system of the present invention and the transfer assist apparatus thereof.

Turning initially to FIG. 5 prior to describing the present invention in detail, a schematic depiction of an exemplary electrophotographic reproducing machine incorporating various machine components is presented in order to provide a general background and understanding of the features of the present invention. Although the apparatus of the present invention is particularly well adapted for use in an automatic electrophotographic reproducing machine as shown in FIG. 5, it will become apparent from the following discussion that the flexible transfer assist blade and apparatus of the present invention is equally well suited for use in a wide variety of electrostatographic processing machines as well as many other known printing systems. It will be further understood that the present invention is not necessarily limited in its application to the particular embodiment or embodiments shown and described herein.

The exemplary electrophotographic reproducing apparatus of FIG. 5 employs a belt 10 including a photoconductive surface 12 deposited on an electrically grounded conductive substrate 14. Drive roller 22, coupled to motor 24 (not shown) by any suitable means, as for example a drive belt, is engaged with belt 10 for transporting belt 10 in the direction of arrow 16 about a curvilinear path defined by drive roller 22, and rotatably mounted tension rollers 20, 23. This system of rollers 20, 22, 23 is used for advancing successive portions of photoconductive surface 12 through various processing stations disposed about the path of movement of belt 10, as will be described.

Initially, a segment of belt 10 passes through charging station A. At charging station A, a corona generating device or other charging apparatus, indicated generally by reference numeral 26, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from the light source are reflected from the original document 28 to form a light image of the original document 28 which is transmitted through lens 34 and focused onto the charged portion of photoconductive surface 12. This imaging process has the effect of selectively dissipating the charge on the photoconductive surface 12 in areas corresponding to non-image areas on the original document 28 for recording an electrostatic latent image of the original document 28 onto photoconductive surface 12. Although an optical imaging system has been shown and described herein for forming the light image used to selectively discharge the charged photoconductive surface 12, one skilled in the art will appreciate that a properly modulated scanning beam of energy (e.g., a laser beam) or other means may be used to irradiate the charged portion of the photoconductive surface 12 for recording a latent image thereon.

After the electrostatic latent image is recorded on photoconductive surface 12, belt 10 advances to development station C where a development system, indicated generally by reference numeral 36, deposits particulate toner material onto the electrostatic latent image. Preferably, a magnetic brush development system 36 is utilized, including a single developer roll 38 disposed in a developer housing 40. In this type of development system, toner particles are mixed with carrier beads in the developer housing 40, generating an electrostatic charge which causes the toner particles to cling to the carrier beads for producing developing material. The magnetic developer roll 38 is rotated within the developer housing 40 to attract the developing material, forming a "magnetic brush" comprising the developer roll 38 having carrier beads with toner particles magnetically attached thereto. As the developer roller 38 continues to rotate, the brush contacts belt 10 where developing material is brought into contact with the photoconductive surface 12 such that the latent image thereon attracts the toner particles from the developing material to develop the latent image into a visible image on the photoreceptor belt 10. A toner particle dispenser, indicated generally by reference numeral 42, is also provided for furnishing a supply of additional toner particles to housing 40 in order to sustain the developing process.

After the toner particles have been deposited onto the electrostatic latent image on the photoconductive surface, the image bearing surface of belt 10 is advanced to transfer station D. At transfer station D, a sheet of support material 56 is moved into contact with the developed toner image via sheet feeding apparatus 58 through chute 54 for placing the sheet 56 into contact with the developed toner image. Preferably, sheet feeding apparatus 58 includes a feed roller 50 which rotates while in frictional contact with the uppermost sheet of stack 52 for advancing sheets of support substrate material into chute 54. Additional feed rollers 53, 55 are provided to guide the support material 56 into contact with the photoconductive surface 12 of belt 10. The developed image on photoconductive surface 12 contacts the advancing sheet of support material 56 in a timed sequence and is transferred thereon at transfer station D.

As shown in the illustrated embodiment, a corona generating device 44 charges the copy sheet 56 to a proper potential so that the sheet is tacked to belt 10 and the toner image on the photoconductive surface 12 thereof is attracted to the sheet 56. Unfortunately, it is not uncommon for air gaps or spaces to exist between the copy sheet 56 and the surface of the belt 10. For example, some publishing applications require imaging onto high quality papers having surface textures which prevent intimate contact of the paper with the developed toner images. In duplex printing systems, even initially flat paper can become cockled or wrinkled as the result of the first side fusing step. Also, color images can contain areas in which intimate contact of toner with paper during the transfer step is prevented by adjacent areas of high toner pile heights. The lack of uniform intimate contact between the belt and the copy sheet in these situations can inhibit transfer and result in image deletions, i.e., image areas where transfer has failed to occur. Contact assisted transfer, as provided by the present invention, is a technique that helps reduce the occurrence of such deletions by creating intimate contact between the copy sheet 56 and the photoreceptor 10 to eliminate or minimize the forces that retard toner migration toward the copy substrate 56. In addition, such uniform intimate contact provides increased transfer efficiency with lower than normal transfer fields, which not only yields better copy quality, but also results in improved toner use efficiency as well as a reduced load on the cleaning system.

In accordance with the present invention, the interface between sheet feeding apparatus 58 and transfer station D includes an apparatus for applying uniform contact pressure to the sheet 56 as the sheet is advanced onto belt 10. Thus, the copy sheet 56 is advanced along a path toward the belt 10 and pressed into contact with the toner powder image on photoconductive surface 12 by means of a segmented flexible blade, indicated generally be reference numeral 82. The blade 82 is moved from a non-operative position, spaced away from the belt 10, to an operative position in contact with the copy sheet 56 adjacent the photoconductive surface at the point of contact therebetween. A cam, indicated generally by reference numeral 84, is provided whereby rotation of the cam moves blade 82 from the non-operative position to the operative position. A light sensor (not shown) may also be provided for detecting the leading and trail edges of the copy sheet as it enters transfer station D to control the actuation of a stepper motor (shown in FIG. 2) for rotating the cam 84. Further details of this apparatus will be described hereinafter with reference to FIGS. 1–4.

After transfer, a corona generator 46 charges the copy sheet 56 with an opposite polarity to detack the copy sheet for belt 10, whereupon the sheet 56 is stripped from belt 10. One skilled in the art will recognize that the image bearing support substrate shown as belt 10 may also be an intermediate transfer member, which carries the toner image to a second transfer station for subsequent transfer to a final image support substrate. These types of members may be charge retentive in nature. Further, while belt type members are described herein, it will be recognized that other substantially rigid or non-compliant members may also be used in combination with the present invention.

After the support material 56 is stripped from belt 10, it is subsequently separated from the belt 10 and transported to a fusing station E. Fusing station E includes a fuser assembly, indicated generally by the reference numeral 60, which preferably comprises a heated fuser roll 62 and a support roll 64 spaced relative to one another for receiving a sheet of support substrate 56 therebetween. The toner image is thereby forced into contact with the support material 56 between fuser rollers 62 and 64 to permanently affix the toner image to support material 56. After fusing, chute 66 directs the advancing sheet of support material 56 to receiving tray 68 for subsequent removal of the finished copy by an operator.

Invariably, after the support material 56 is separated from belt 10, some residual developing material remains adhered to the photoconductive surface 12 thereof. Thus, a final processing station, namely cleaning station F, is provided for removing residual toner particles from photoconductive surface 12 subsequent to transfer of the toner image to the support material 56 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle.

The foregoing description should be sufficient for the purposes of the present application for patent to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

Moving now to FIGS. 1–4, the particular features of the transfer assist apparatus of the present invention will be described in greater detail. With specific reference to FIG. 1, the transfer assist apparatus is depicted in an enlarged side view to more clearly reveal the various components included therein. As shown in this figure, feed rollers 53 and 55 are rotated in opposite directions for transporting a sheet of copy substrate (not shown) toward transfer assist blade 82. The transfer assist blade 82 is fixedly mounted to a support armature 81. A support baffle 83 is also provided opposite the transfer assist blade 82, forming a channel therethrough for guiding the copy substrate in a direction toward belt 10. A cam 84 is positioned adjacent blade 82 at a location outside of the channel formed between blade 82 and support baffle member 83 for selectively deflecting the blade 82 toward the belt 10.

Figure 2:
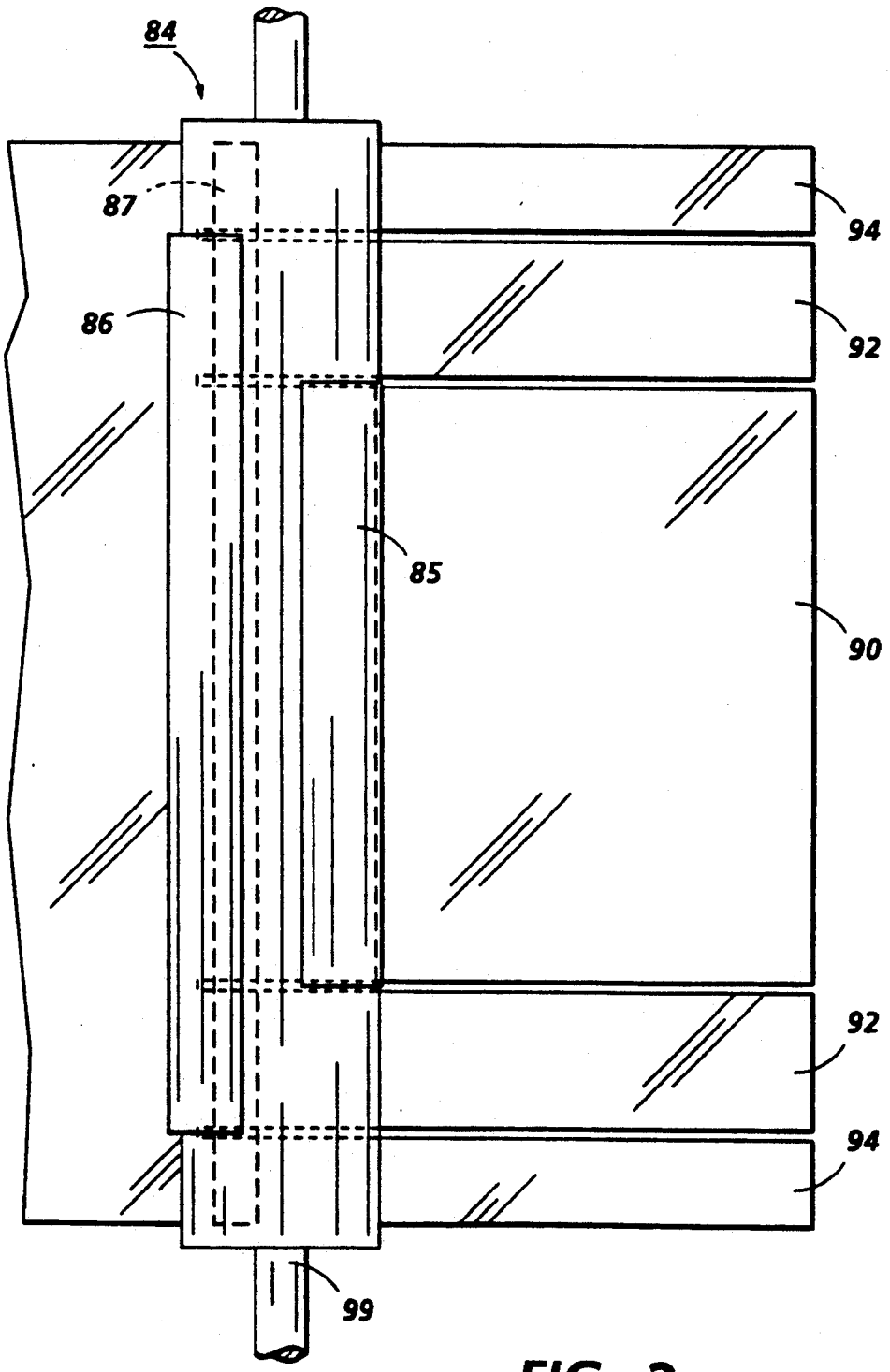
FIG. 2 is a plan view showing the segmented flexible transfer assist blade and the actuating cam of the present invention.

Referring now to FIG. 2, transfer blade 82 is segmented in order to accommodate copy substrates of various widths. The embodiment shown in FIG. 2 demonstrates an arrangement suitable for applying uniform contact pressure to standard copy substrate widths of 4½ inches, 8½ inches, and 11 inches in a center registered xerographic machine. As will be understood from the embodiment depicted in FIG. 2, a central segment 90 may be driven into the operative position separate from peripheral segments 92 and 94 which may, themselves, be driven to their operative position corresponding with the dimensional width of the copy sheet. Thus, peripheral segments 92 and/or 94 may or may not be paired with their counterpart segments, respectively, on opposite sides of the central segment 90 to provide transfer assist contact along the outside edges of variously dimensioned copy substrates. Central segment 94 are each peripheral segment pair 92 or 94 are moved into the operative position by means of individual cam lobes 85, 86 or 87, which independently contact the surface of the transfer blade 82 to deflect the respective segments toward the belt 10. It will be understood by those of skill in the art that a reasonable extension of this arrangement may include a larger number of segments selectively controlled to apply pressure to many variously dimensioned copy substrates. A further reasonable extension of this arrangement might be configured to provide a central segment along one side with ancillary segments corresponding to the various dimensions of copy sheets along the opposite side, as for example, in a side registered xerographic machine.

Figure 3:
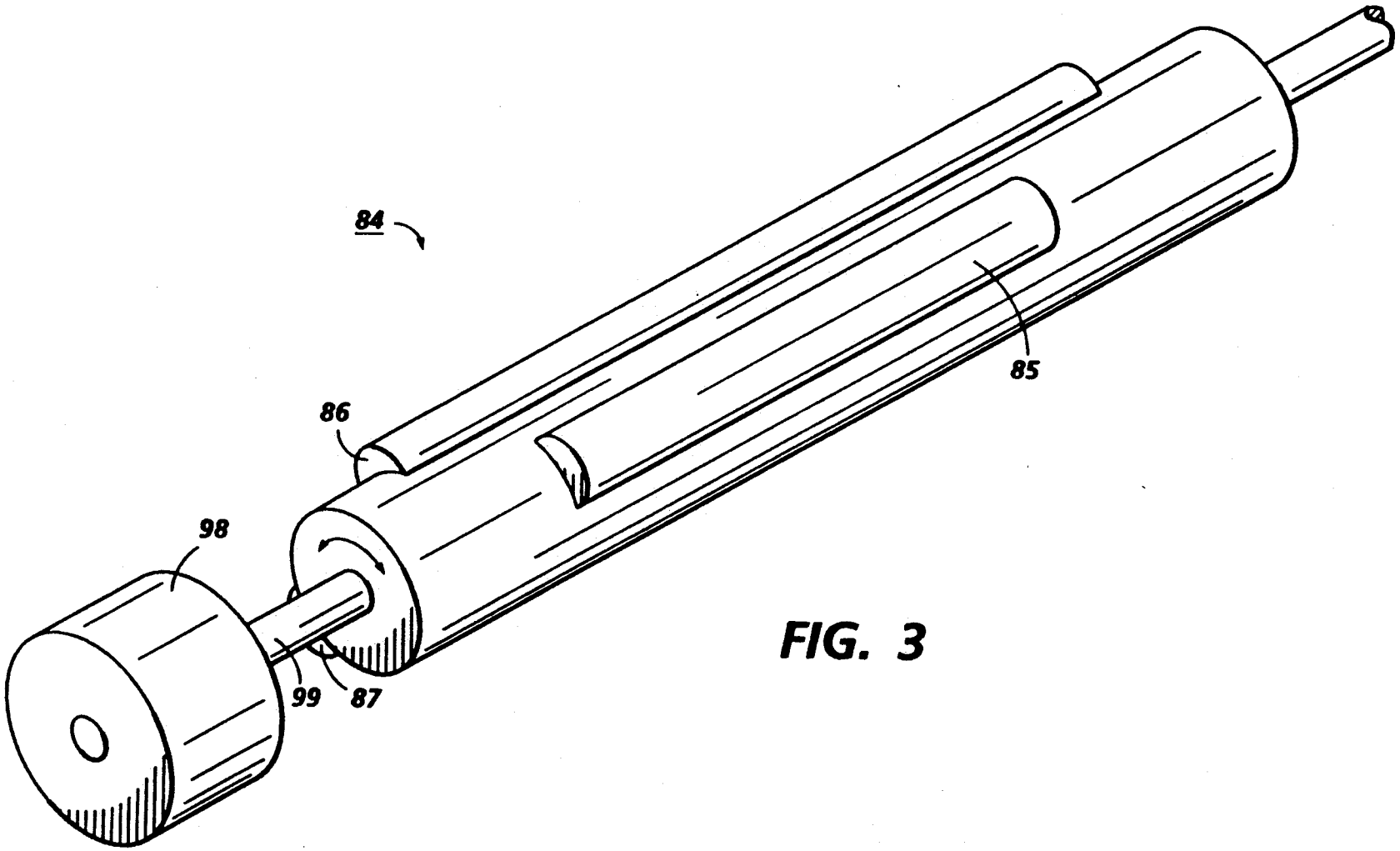
FIG. 3 is a perspective view of an actuating cam which may incorporated into the transfer assist apparatus of the present invention.

FIG. 3 depicts a cam shaft of the type which would be appropriate for shifting selected segments of the transfer assist blade of FIG. 2. The cam shaft 84 includes independent lobes 85, 86, 87 corresponding in length to the various dimensions of the particular segments of the transfer assist blade 82. A first lobe 85 corresponds to central segment 90, a second lobe 86 corresponds to the dimensions of the peripheral segments 92 in addition to central segment 90, and a third lobe 87 is provided with a length corresponding to peripheral segments 94 for deflecting those peripheral segments, as well as, peripheral segments 92 and central segment 90. As shown in FIG. 3, the cam is driven by a stepper motor 98 having a rotatable shaft 99 operatively associated with the cam 84 to apply rotational force thereto. In the depicted embodiment, motor 98 enables the cam to be rotated 90 degrees for a typical 4½ inch wide copy sheet, 180 degrees for an 8½ inch wide copy sheet and 270 degrees for a typical 11 inch wide copy sheet. It will be appreciated that the angular displacement required to be provided by the motor can be reduced by positioning the cam lobes at, for example, 45°, 90° and 135°, or 30°, 60° and 90° or even at lesser intervals. The amount of rotation required for a given copy or print cycle is determined by a sensing mechanism which is typically provided in an electrostatographic machine for detecting the dimension of the output copy sheet.

The stepper motor 98 is also coupled to a sensor via a control system (not shown) for detecting the lead edge and trail edge of the copy sheet as it enters into the transfer zone, thereby providing the capability of selectively energizing and de-energizing the stepper motor 98 for deflecting the blade 82 to the operative position against the back of the copy sheet when the copy sheet is present and, conversely, to the non-operative position when the trailing edge of the copy sheet has been detected and the copy sheet is not present. An exemplary lead edge/trail edge detection sensor and circuitry therefore is disclosed in U.S. Pat. No. 4,341,456 issued to Iyer et. al. in 1982, the relevent portions of which are hereby incorporated by reference herein. It will be recognized that lead edge detection can be implemented in such a way that the stepper motor 98 can be actuated just prior to the arrival of a copy sheet in the transfer area in order to maximize the utilization of available time for completing the transition between blade movement from the non-operative to the operative positions. The stepper motor control system may include closed or open loop control functions for providing accurate positional measurement and movement of the cam shaft.

Figure 4:
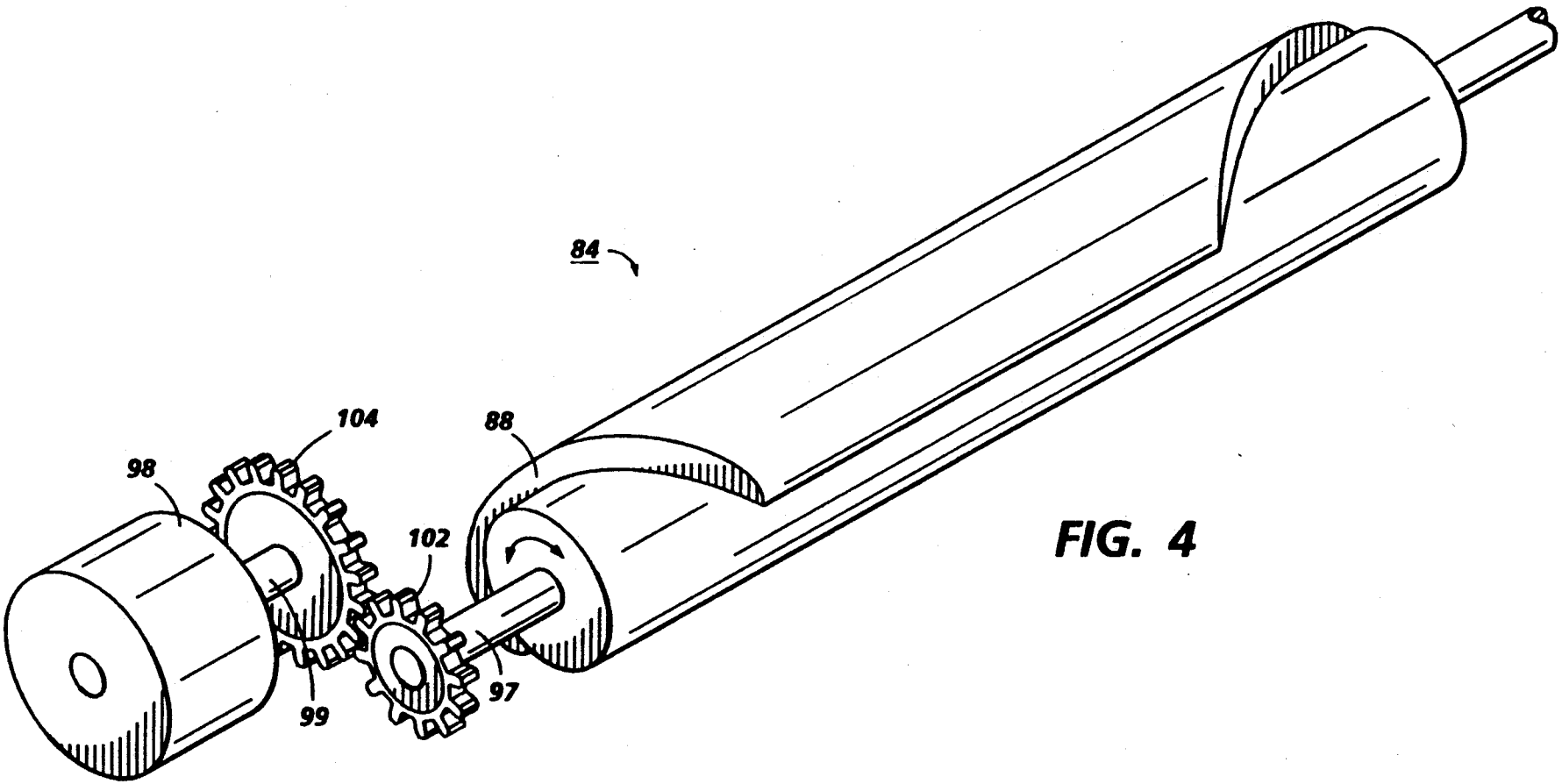
FIG. 4 is a perspective view of an alternative embodiment of the actuating cam of FIG. 3.

FIG. 4 illustrates an alternative embodiment of the cam shaft depicted in FIG. 3. In this alternative embodiment, a singular lobe 88 is provided with a continuously increasing height and lengthwise dimension. The lobe configuration of this alternative embodiment permits selective deflection of the segmented transfer blade of FIG. 2 while eliminating undulating motion of various segments of the blade as may be generated by blade contact of the null areas between respective lobes in the cam of FIG. 3. The continuously increasing lengthwise dimension of this alternative embodiment for cam shaft 84 creates continuous deflection of various segments upon actuation as the cam shaft rotates to the appropriate position defined by the size of the output copy sheet. Further, the continuously increasing height of the cam lob in this alternative embodiment permits increased deflection of the blade 83 relative to the angular rotation of the cam 84. Thus, a decrease in stiffness of the blade 83, as might be generated, for example, over the life of the blade, may be compensated for by rotating the cam 84 by an additional amount to cause increased deflection of the blade, thereby delivering nominal pressure to the copy sheet. This process also extends the life of the transfer blade so that a blade having borderline flex characteristics might still provide satisfactory results.

In addition to the features described above, the alternative embodiment, shown in FIG. 4, also includes a gear arrangement 102, 104 for coupling stepper motor 98 to cam shaft 84. The gear ratio is selected to obtain a desired torque, velocity or other timing advantages as would be understood by one skilled in the art.

In operation, when the leading edge of a copy sheet is detected at the inlet to transfer station D, cam 84 is rotated by the energization or activation of motor 98 thereby rotating an independent lobe 85, 86 or 87 or a portion of lobe 88 into contact with the transfer assist blade 82. A sensor, as for example, a light sensing device, detects the leading edge of the copy sheet entering the transfer station and transmits a signal via control circuitry to stepper motor 98. The stepper motor is energized to rotate the cam shaft such that a predetermined cam lobe corresponding the dimensional width of the copy sheet is placed in contact with the transfer assist blade to deflect the transfer assist blade 82 into contact with the back of the copy sheet, thereby pressing the copy sheet against the developed toner powder image on photoconductive belt 10. Thus, the transfer assist blade 82 is deflected into an operative position against the backside of a copy sheet. The contact pressure generated by the transfer assist blade 82 substantially eliminates any spaces or gaps which may exist between the copy sheet and the toner powder image to substantially improve the transfer of the toner powder image to the copy sheet. As the copy sheet passes through the transfer zone, the sensor detects the trailing edge of the copy sheet, transmitting a signal to the stepper motor which causes the cam to rotate in a direction opposite the previous rotation so as to move the cam lobe away from abutting contact with the transfer assist blade 82 to a position in which no cam lobe is in contact with the transfer assist blade. In this position, the transfer assist rests in a non-operative position and does not contact the photoconductive surface of belt 10. Preferably, transfer assist blade 82 is made from a thin flexible sheet material such as Mylar, available from E. I. DuPont de Nemours, Inc. of Wilmington Del., or some other polyester sheet material which is elastically deformable. It will be appreciated that the segmented transfer assist blade embodiment disclosed herein is designed to provide contact across the entire width of standard size copy sheets in a center registered xerographic printing machine. Moreover, the combination of this segmented transfer assist blade with the cam 84, permits uniform contact with various sheet dimensions while preventing contact between the peripheral edges of the transfer assist blade and the photoreceptor which may cause damage to the photoreceptor or contamination of the transfer assist blade.

In review, the transfer system of the present invention includes a flexible blade member normally resting in a non-stressed position spaced from the photoconductive surface of a belt in a non-operative position. A rotatable cam shaft is provided adjacent the blade member for deflecting selected segments of the blade into an operative position for pressing against a copy sheet to create intimate contact between a toner powder image developed on the photoconductive surface and the copy sheet. A corona generating device generates a transfer field effective to transfer the toner powder image from the photoconductive surface to the copy sheet while the contact pressure provided by the transfer assist blade eliminates air gaps between the copy sheet and the photoconductive surface to prevent image deletions.

It is, therefore, evident that there has been provided, in accordance with the present invention, an electrophotographic printing apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, the present application for patent is intended to embrace all such alternatives, modifications, and variations as are within the broad scope and spirit of the appended claims.

We claim:

1. An apparatus for providing substantially uniform contact between a copy substrate and a developed image located on an imaging member, comprising:

contact means, adapted to move from a non-operative position spaced from the imaging member to an operative position in contact with the copy substrate on the imaging member, for applying pressure against the copy substrate in a direction toward the imaging member, said contact means including a flexible blade member and fixedly mounted means for supporting said blade member; and means, including an elevated deflecting surface, for applying a load to said contact means to deflect said contact means into said operative position, said flexible blade member includes a plurality of blade segments such that selected blade segments have a cumulative widthwise dimension corresponding to a widthwise dimension of the copy substrate.

2. The apparatus of claim 1, wherein said rotatable cam member includes a plurality of lobes for applying a load to selected blade segments of said flexible blade member.

3. The apparatus of claim 2, wherein said rotatable cam member is selectively rotated to a predetermined angular position for placing a selected one of said cam lobes into abutting relationship with said flexible blade element for deflecting selected blade segments thereof into said operative position.

4. The apparatus of claim 1, wherein said rotatable cam member includes a singular cam lobe having a continuously varying widthwise dimension for selectively applying a load to selected blade segments of said flexible blade member.

5. The apparatus of claim 4, wherein said rotatable cam member is selectively rotated to a predetermined angular position for placing a selected portion of said cam lobe into abutting relationship with said flexible blade element for deflecting selected blade segments thereof into said operative position.

6. An electrostatographic printing machine including a transfer station for transferring a developed image from a moving imaging member to a moving copy substrate, including an apparatus for providing substantially uniform intimate contact between the copy substrate and the developed image located on the imaging member, comprising:

contact means, adapted to move from a non-operative position spaced from the imaging member to an operative position in contact with the copy substrate on the imaging member, for applying pressure against the copy substrate in a direction toward the imaging member, said contact means including a flexible blade member and fixedly mounted means for supporting said blade member; and means, including an elevated deflecting surface, for applying a load to said contact means to deflect said contact means into said operative position, said flexible blade member includes a plurality of blade segments such that selected blade segments have a cumulative widthwise dimension corresponding to a widthwise dimension of the copy substrate.

7. The electrostatographic printing machine of claim 6, wherein said rotatable cam member includes a plurality of lobes for applying a load to selected blade segments of said flexible blade member.

8. The electrostatographic printing machine of claim 7, wherein said rotatable cam member is selectively rotated to a predetermined angular position for placing a selected one of said cam lobes into abutting relationship with said flexible blade element for deflecting selected blade segments thereof into said operative position.

9. The electrostatographic printing machine of claim 6, wherein said rotatable cam member includes a singular cam lobe having a continuously varying widthwise dimension for selectively applying a load to selected blade segments of said flexible blade member.

10. The electrostatographic printing machine of claim 9, wherein said rotatable cam member is selectively rotated to a predetermined angular position for placing a selected portion of said cam lobe into abutting relationship with said flexible blade element for deflecting selected blade segments thereof into said operative position.

* * * * *